US005318388A

United States Patent [19]

Papadopoulos

[11] Patent Number: 5,318,388

[45] Date of Patent: Jun. 7, 1994

[54] IMPROVEMENT IN OR RELATING TO A SHORING LEG: A SHORING LEG WITH A LATCH

[75] Inventor: Demetrios G. Papadopoulos, Hounslow, England

[73] Assignee: SGB Holdings Limited, Mitcham, England

[21] Appl. No.: 990,581

[22] Filed: Dec. 16, 1992

[30] Foreign Application Priority Data

Apr. 8, 1992 [GB] United Kingdom ..... 9207641

[51] Int. Cl.[5] ..... E21D 15/00

[52] U.S. Cl. ..... 405/290; 403/329; 405/288; 405/230

[58] Field of Search ..... 405/290, 230, 288; 285/319, 921; 403/329, 326, 324; 248/354.4, 354.6

[56] References Cited

U.S. PATENT DOCUMENTS

| | | | |
|---|---|---|---|
| 865,080 | 9/1907 | Candee | 405/280 |
| 968,450 | 8/1910 | Conking | 405/278 |
| 1,841,647 | 1/1932 | Smith | 403/329 X |
| 2,128,428 | 8/1938 | Murray | 405/278 |
| 2,932,481 | 4/1960 | Breer et al. | 248/354.6 |
| 3,362,167 | 1/1968 | Ward | 405/282 |
| 3,470,699 | 10/1969 | Cox | 405/282 |
| 3,688,508 | 9/1972 | Taylor | 405/278 |
| 3,901,609 | 8/1975 | Gostling | 403/49 |
| 3,902,326 | 9/1975 | Langenbach | 405/230 X |
| 4,657,442 | 4/1987 | Krings | 405/282 |
| 4,907,675 | 3/1990 | Saby | 182/178 |
| 4,986,690 | 1/1991 | Cooksey | 403/353 X |
| 5,048,875 | 9/1991 | Usui et al. | 285/319 |

FOREIGN PATENT DOCUMENTS

| | | |
|---|---|---|
| 2633147 | 1/1978 | Fed. Rep. of Germany . |
| 3102211 | 12/1981 | Fed. Rep. of Germany . |
| 3641349 | 6/1988 | Fed. Rep. of Germany . |
| 332026 | 7/1930 | United Kingdom . |
| 639129 | 6/1950 | United Kingdom . |
| 2234005A | 1/1991 | United Kingdom . |
| 2234776A | 2/1991 | United Kingdom . |

OTHER PUBLICATIONS

European Search Report for Application No. EP 92 11 9719.

UK Search Report for Application No. GB 9127106.4.

UK Search Report for Application No. GB 9127107.2.

UK Search Report for Application No. GB 9207641.3.

*Primary Examiner*—Dennis L. Taylor

*Attorney, Agent, or Firm*—Arnold, White & Durkee

[57] ABSTRACT

A shoring leg provided with a latch for use in maintaining an end plate on the shoring leg and a jack collar in a predetermined position relative to each other, the latch comprising a latch member mounted on the leg to execute a movement from a latching position to a release position, the latch member defining a recess jaw adapted, when in the latching position, to receive part of the leg end plate and to receive a corresponding part of an adjacent collar of a jack to retain the end plate and the collar in said predetermined position, there being means to retain the latch member in the latching position.

10 Claims, 3 Drawing Sheets

IMPROVEMENT IN OR RELATING TO A SHORING LEG: A SHORING LEG WITH A LATCH

The present invention relates to a shoring leg and more particularly relates to a shoring leg provided with a latch.

It has been proposed previously to provide a shoring system in which a plurality of vertical legs are provided, an adjustable jack being provided at the bottom of each leg. A screw threaded portion of the jack is inserted into the leg and the jack carries a rotatable threaded collar which abuts an end plate carried by the leg. As the collar is rotated it moves up, or down the threaded portion of the jack, thus lifting, or lowering, the leg. It is a common problem, that when moving the vertical legs, the jack can become disconnected from the leg, thereby necessitating extra work in relocating the jack within the leg. The present invention seeks to obviate or reduce the problem outlined above.

According to this invention there is provided a shoring leg provided with a latch for use in maintaining an end plate on the shoring leg and a jack collar in a predetermined position relative to each other, the latch comprising a latch member mounted on the leg to execute a movement from a latching position to a release position, the latch member carrying a recess adapted when in the latching position, to engage the leg end plate and an adjacent collar of a jack to retain the end plate and the collar in said pre-determined position, there being means to retain the latch member in the latching position.

Figure 1:
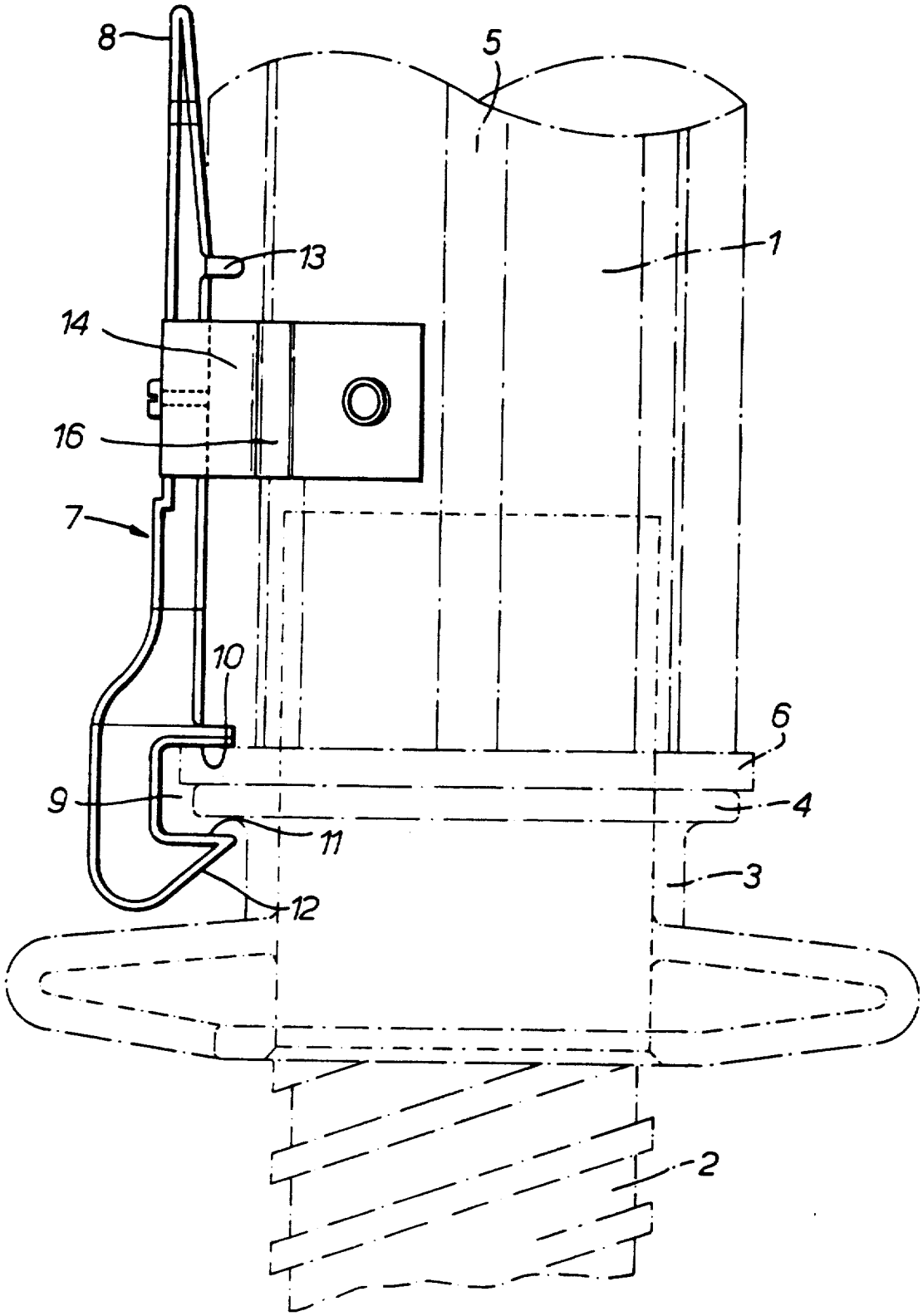
Figure 2:
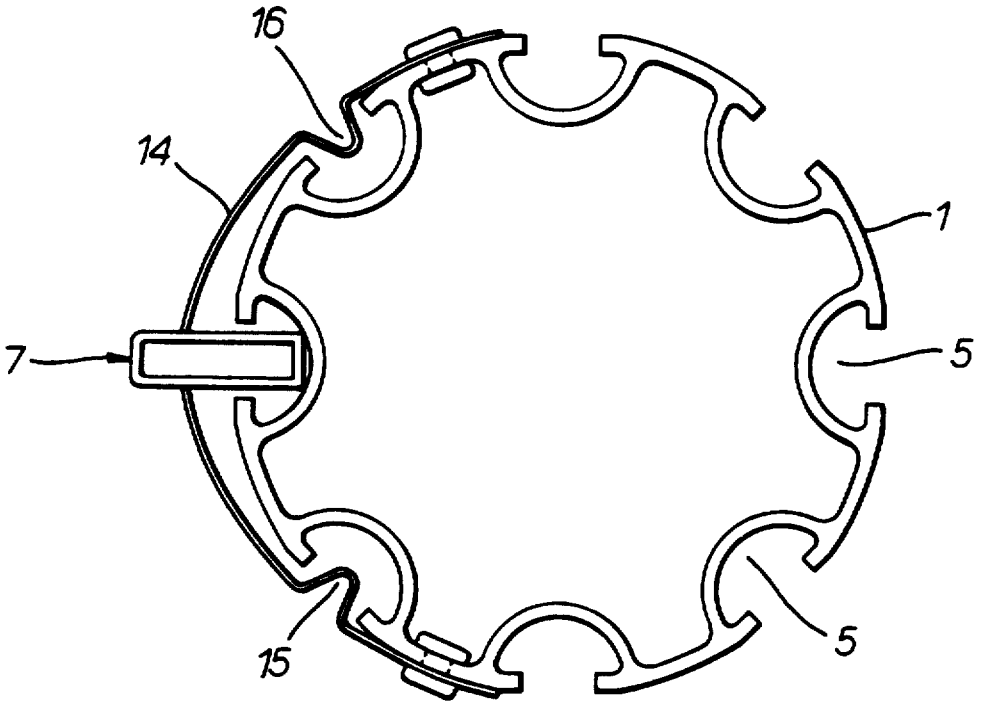
Figure 3:
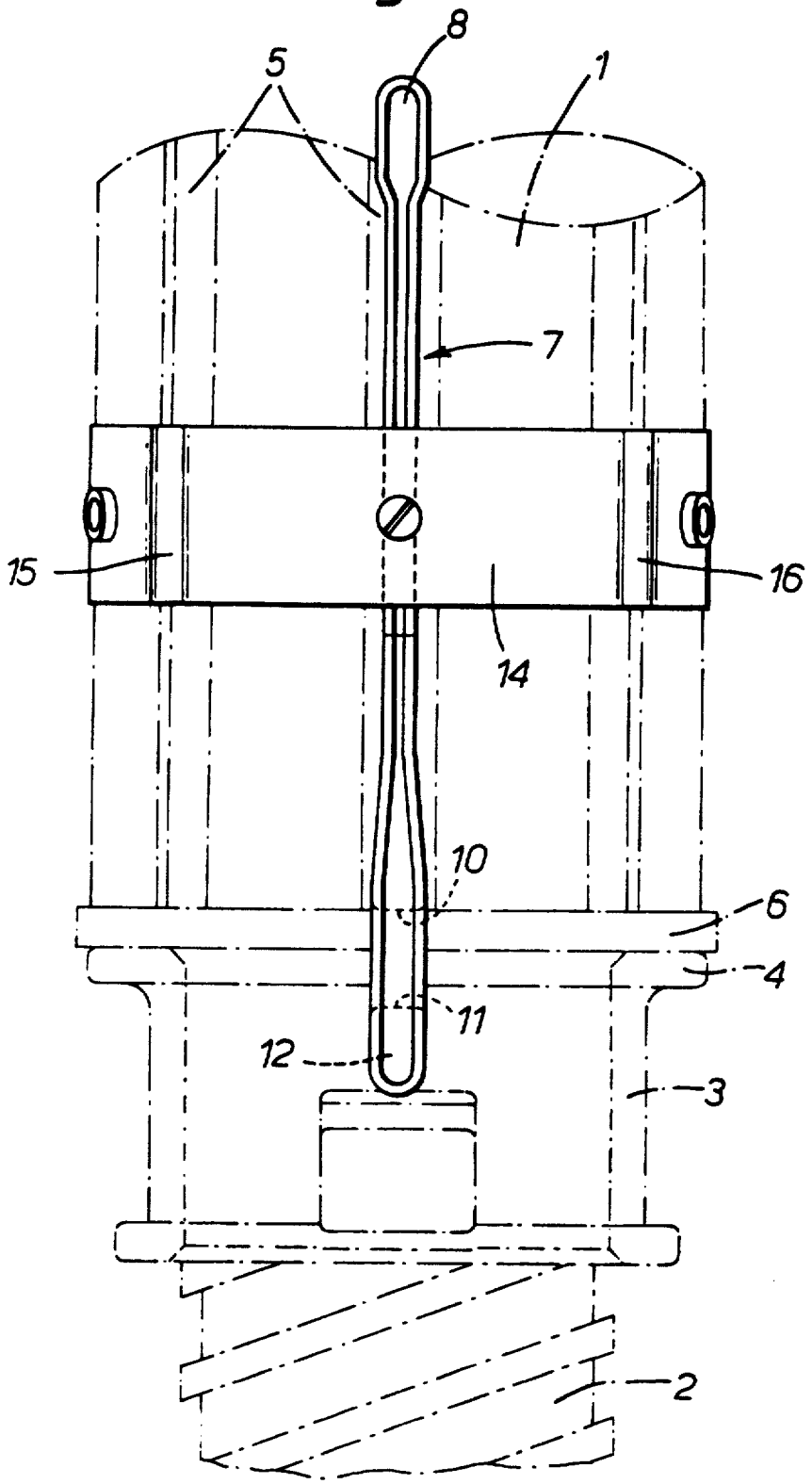

In order that the invention may be more readily understood, so that further features thereof may be appreciated, the invention will now be described, by way of example, with reference to the accompanying drawings in which:

FIG. 1. is a side view of a shoring leg latch attached to a shoring leg and engaging a jack collar, the leg and the jack being shown partly in phantom;

FIG. 2 is an end view of the leg and latch of FIG. 1 with the end plate of the leg removed; and FIG. 3 is a front view of the latch of FIGS. 1 and 2, parts of the leg and jack again being shown in phantom.

Referring to the drawings, a hollow vertical shoring leg 1 is provided, at its lower end, with an adjustable jack 2. The jack 2 has a portion (not shown) engaging the ground which supports a vertical screw threaded portion on which is rotatably mounted an internally threaded collar 3. The screw threaded portion of the jack 2 is dimensioned to be received within the hollow leg 1. The collar 3 has an upper radially outwardly projecting lip 4 dimensioned to engage the lower end of the leg 1 and thus support the leg.

The leg 1 consists of an extruded tube of aluminium with a substantially circular cross section. The outer surface of the leg 1 is provided with axially extending channels 5. The leg 1 carries an end plate 6 fixed at the bottom of the leg 1 which engages the collar 3. The end plate 6 is circular and projects radially outwardly of the leg 1.

When shoring incorporating the leg 1 is to be moved, the leg 1 may be lifted. In order to prevent the jack 2 from becoming separated from the leg 1 when the leg is lifted a latch 7 is provided which acts to retain the jack 2 in position.

The latch 7 comprises a vertical elongate member 8 which is partially disposed in one of the axially extending channels 5 of the leg 1. The upper portion of the exposed front face of the elongate member carries a finger tab 8. The lower portion of the rear face of the elongate member defines a rearwardly recess 9 which opens towards the rear of the member 8. The inwardly projecting recess 9 is bounded by two opposed horizontal walls 10, 11 which are substantially perpendicular to the main axis of the elongate member. A sloping cam surface 12 is provided which extends from the lower wall bound to the recess 11 to the lower free end of the latch 7. A fulcrum stub 13 is also provided on the rear face of the elongate member. The stub is located closer to the finger tab then to the recess. The fulcrum stub 13 is totally disposed within channel 5, and is directed towards the leg.

The latch 7 is located at the bottom end of the leg 1 so that the recess 9 is aligned with the endplate 6 of the leg 1 and can accommodate both a peripheral part of the end plate 6 and a corresponding part of the collar lip 4, when the lip is adjacent to the end plate.

A leaf spring 14 is provided which is of substantially semi-circular shape having two inwardly projecting folds 15, 16 equispaced from the middle of the leaf spring 14.

The leaf spring 14 is positioned over the latch 7 so that the two folds 15 and 16 are partially disposed within the axially extending channels on either side of the channel in which the latch is disposed. The two opposed ends of the leaf spring 14 are fixedly attached to the leg 1 by rivets. The latch 7 is mounted to the leaf spring 14 by a screw which passes through a centrally located aperture in the leaf spring 14 and is secured in a corresponding threaded portion of the latch 7 which is located at substantially the mid point of the elongate member.

In normal use the latch 7 is biased into a capture position as shown in FIG. 1. In this position, the upper wall defining the recess is in direct contact with the upper surface of end plate 6 and the collar lip 4 which abuts end plate 6 is accommodated within the recess 9. If, for any reason, such as the leg being moved, the collar 3 starts to separate from the leg 1 the lower wall defining the recess wall 11 restrainingly engages the collar lip 4 thereby holding the jack 2 and the leg 1 together and preventing separation thereof. Because the upper wall defining the recess contacts the end plate 6, the load applied to the elongate member is restricted to the region defining the recess thus, no loads are transmitted through the latch 7 to the point at which the latch 7 is attached to the leaf spring 14. Consequently, leaf spring 14 and the remainder of the latch structure can be made using lightweight materials which do not have to be load bearing. However, the part of the elongate member defining the recess is formed from a strong material which can withstand sufficient loads to prevent the jack 2 and the leg 1 from separating.

It should also be noted that the collar 3 can be rotated about the jack 2 allowing the jack height to be raised or lowered whilst the latch 7 remains in the capture position.

To release the latch 7, the finger tab 8 is depressed. The leaf spring 14 deforms as the finger tab 8 is lowered within the channel 5 of the leg 1. The fulcrum stub 13, which is in constant contact with an inside surface of the channel 5, causes the latch 7 to pivot about the fulcrum stub 13 causing any movement at the finger tab 8 to be magnified at the lower end of the latch 7 by the lever motion of the fulcrum stub 13. When the finger tab 8 is fully depressed within the channel 5, the latch 7 is in a released position and the collar 3 can be easily removed, thus allowing the portion of the jack 2 within the leg 1 to be withdrawn.

The latch 7 is in a naturally biased capture position, so that when the lag is lowered into the jack 2, the cam surface 12 comes into contact with the collar lip 4. The cam surface slides over the collar lip 4 causing the lower part of the elongate member to move in a radially outward direction until the collar lip 4 passes over the lower wall defining the recess and is captured within the recess 9 as the latch 7 returns to the naturally biased capture position.

Alternatively, the leg 1 may be lowered onto the jack 2 with the finger tab 8 fully depressed. Thus, the cam surface 12 does not come into contact with the collar lip 4 and the finger tab 8 is not released until the collar lip 4 comes into contact with the end plate 6. When this occurs, the finger tab 8 is released and the latch returns to the naturally biased capture position.

What is claimed is:

1. A shoring leg, an end plate mounted on the shoring leg, and a latch mounted on the shoring leg for use in maintaining the end plate in a predetermined position relative to a collar present on a jack, the latch comprising a latch member, means mounting the latch member relative to the leg, whilst enabling the latch member to execute a movement, relative to the leg from a latching position to a release position, the latch member defining a recess adapted, when the latch is in the latching position, to receive part of the leg end plate and to receive a corresponding part of an adjacent collar of said jack to retain the end plate and the collar in said predetermined position, there being means to retain the latch member in the latching position.

2. A leg according to claim 1 wherein the latch member is an elongate member, the recess being defined adjacent one end of the latch member.

3. A leg according to claim 1 wherein the means to retain the latch member in the latching position is resilient means.

4. A leg according to claim 3 wherein the resilient means comprise a leaf spring.

5. A leg according to claim 4 wherein the leaf spring is positioned to at least partly surround said leg, the leaf spring being provided with one or more folds formed therein.

6. A leg according to claim 5 wherein the leg is provided with axially extending channels, the folds being adapted to protrude inwardly and being at least partially disposed within the channels which extend along the leg.

7. A leg according to claim 2 wherein the leg is provided with at least one channel extending axially along the outer surface of the leg, the elongate member being received in said channel.

8. A leg according to claim 2 wherein the latch member is provided with the fulcrum which is positioned to provide mechanical advantage when the other end of the elongate member is moved to pivot the member about said fulcrum.

9. A leg according to claim 2 wherein the said one end of elongate member is provided with an inclined cam face.

10. A leg according to claim 1 in combination with a jack, the jack having a collar adjacent the end plate of the leg, part of the end plate of the leg and a corresponding part of the collar being received within said recess.

* * * * *